US005718427A

United States Patent [19]

Cranford et al.

[11] Patent Number: 5,718,427

[45] Date of Patent: Feb. 17, 1998

[54] HIGH-CAPACITY AUTOMATIC PLAYING CARD SHUFFLER

[75] Inventors: Tony A. Cranford, 12252 W. Chenango Dr., Morrison, Colo. 80465; Thomas E. Sawyer, P.O. Box 699, Idaho Springs, Colo. 80452; Michael G. Humecki; Richard G. Stewart, both of Colorado Springs, Colo.; Gerald A. Dal Ferro, Palmer Lake, Colo.

[73] Assignees: Tony A. Cranford, Morrison; Thomas E. Sawyer, Idaho Springs, both of Colo.

[21] Appl. No.: 720,594

[22] Filed: Sep. 30, 1996

[51] Int. Cl.[6] ..... A63F 1/12

[52] U.S. Cl. ..... 273/149 R

[58] Field of Search ..... 273/149 R

[56] References Cited

U.S. PATENT DOCUMENTS

| | | | |
|---|---|---|---|
| 1,846,063 | 2/1932 | Matthaey | 273/149 R |
| 2,661,215 | 12/1953 | Stevens | 273/149 R |
| 2,706,117 | 4/1955 | Notz | 273/149 R |
| 2,755,090 | 7/1956 | Aldrich | 273/149 R |
| 4,310,160 | 1/1982 | Willette et al. | 273/149 R |
| 4,515,367 | 5/1985 | Howard | 273/149 R |
| 4,969,648 | 11/1990 | Hollinger et al. | 273/149 R |
| 5,445,377 | 8/1995 | Steinbach | 273/149 R |
| 5,575,475 | 11/1996 | Steinbach | 273/149 R |

*Primary Examiner*—Raleigh W. Chiu

*Attorney, Agent, or Firm*—John R. Ley; John B. Phillips

[57] ABSTRACT

Playing cards from two unshuffled card stacks are interleaved or shuffled in random by propelling the cards in two intersecting trajectories and interleaving the cards into a single shuffled card collection at the intersection point of the trajectories. Two card holding bins receive the unshuffled card stacks of playing cards and preferably a random number of cards are removed at a time. The interleaved cards settle downward onto an elevator assembly to form the shuffled card collection.

32 Claims, 7 Drawing Sheets

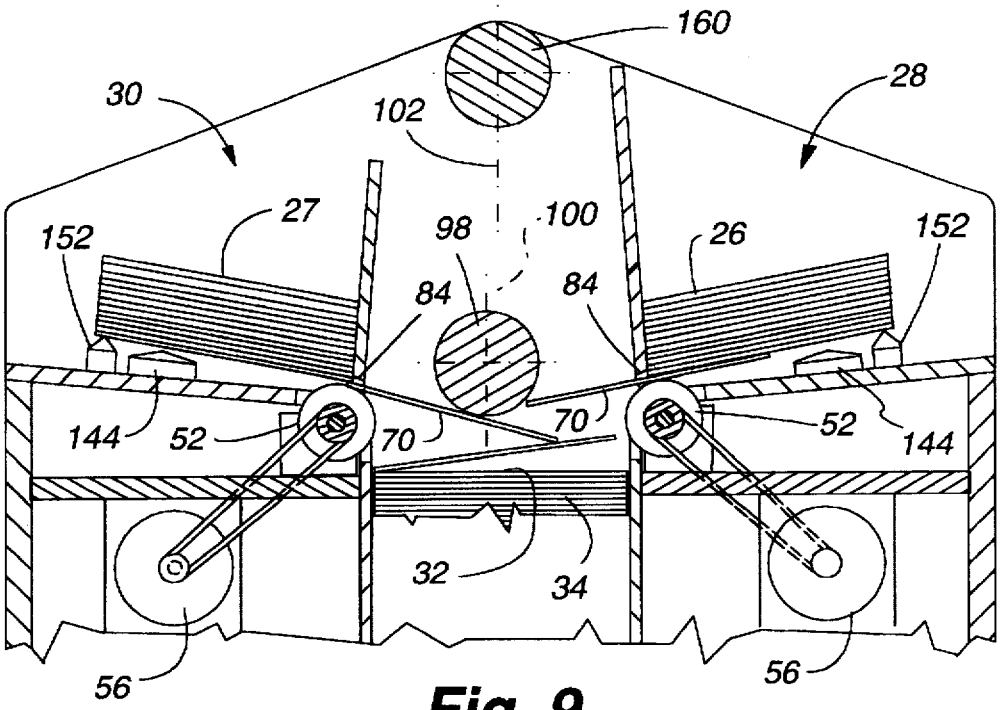
Fig. 9
Fig. 10
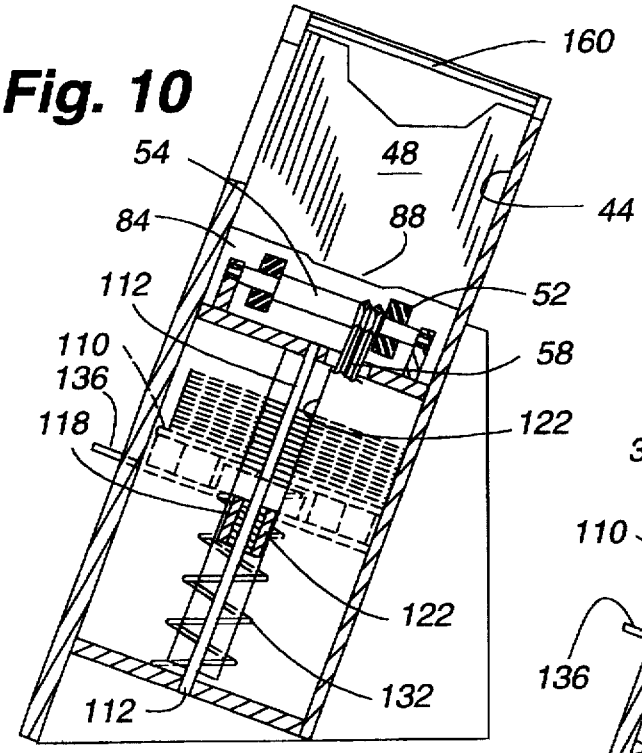
Fig. 11
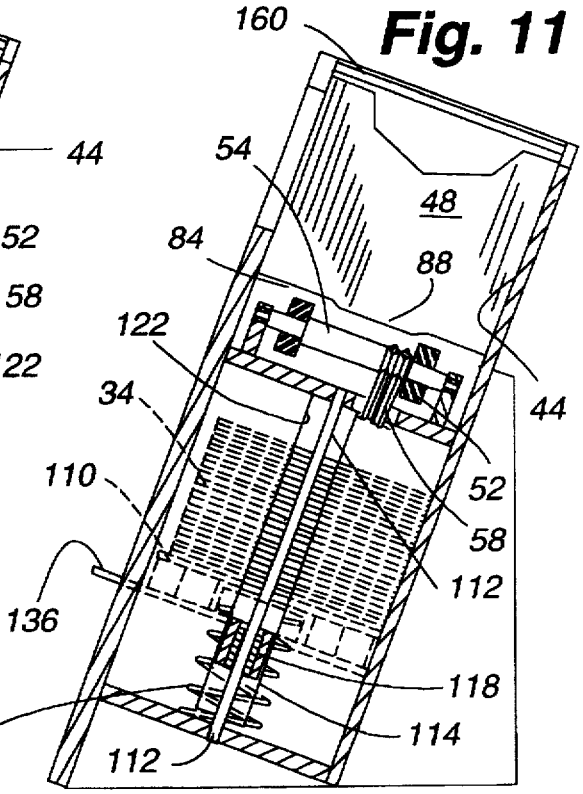

HIGH-CAPACITY AUTOMATIC PLAYING CARD SHUFFLER

This invention relates to shuffling playing cards automatically, and more particularly to a new and improved machine which automatically shuffles the order of a relatively large number of playing cards simultaneously and in a relatively rapid and effective manner.

BACKGROUND OF THE INVENTION

Machines that can quickly, effectively and automatically shuffle the order of a large number of playing cards assembled from a multiplicity of card decks are in growing demand in gambling casinos and other environments where large numbers of cards are played in relatively short periods of time. For example, the card game of blackjack or "21" is frequently played in rounds using six to eight decks of cards at a time. After a round of play, the dealer must shuffle all of the cards in all of the decks being used before the next round of play can commence. To shuffle the large number of cards in the six to eight decks, the dealer typically breaks the cards into separate groups of cards, shuffles each group separately, and then combines the separately shuffled card groups into the single collection before the next round of play can resume.

While most-professional card dealers are very rapid in their shuffling actions, the large number of cards to be handled still requires a significant amount of time to shuffle. The profitability to a casino of a card game such as blackjack is directly related to the number of rounds of the game which can be played during a specific time interval. The time required to stop play between rounds for shuffling the playing cards becomes a significant limitation in the number of rounds which can be played. Even playing a few more rounds of a gambling game in each hour may significantly increase the profitability of the game to the casino. Furthermore, the physical acts required to shuffle the decks contribute to the fatigue of the dealer and limit the time which the dealer may work at the game. The casino must therefore employ more dealers to relieve those dealer who become fatigued after shorter intervals of play.

Many serious card players are suspicious of or object to the dealer making physical hand contact with the playing cards, out of concern that randomness in the order or position of the shuffled cards not be accomplished, or will not be accomplished fairly. Randomness in the order of the shuffled collection of cards is essential to fair play of the game from a player's standpoint, particularly because the odds associated with such gambling games favor the casino. Many serious players therefore insist on the opportunity to observe the cards during the shuffling process to thereby enhance their confidence in the integrity of shuffled card collection. To less serious players, the opportunity to watch the card shuffling process is an aspect of entertainment associated with playing the game.

Another practical concern is the amount of available space on a gaming table. The available space is usually limited, particularly when the gaming table is completely occupied by players. Gaming tables are usually of a uniform size, and this size is an important factor in determining the number of gaming tables which can be placed on a specific amount of floor space within a casino. Thus, anything which occupies a significant amount of space on the gaming table, or which restricts the placement of the gaming tables within the casino, also has a detrimental effect on the efficiency and style of the conduct of the games conducted by a casino.

Automatic card shuffling machines are available. However, most of these previous automatic card shuffling machines are subject to certain disadvantages which have restricted or prevented their widespread acceptance in gambling casinos and by serious players. For example, many of these previous machines are relatively large in size, thereby even further limiting the restricted space available on the gaming table. The size and shape of these previous devices is not pleasing from an aesthetics standpoint. The size of these previous devices is generally the result of the mechanisms used to shuffle the cards. The size of these machines can not be reduced because the shuffling mechanism is large and complex, and can not be reduced in size.

Furthermore, the complexity of the prior automatic shuffling machines generally require a conventional AC electrical power source for operation. The gaming table must be placed close to an electrical outlet because the shuffling machine cannot be located at a remote location from the table. Most casinos do not have electrical outlets at each gaming table. Electrical extension cords are therefore required to bring electrical power from the remote outlet to the gaming table. Electrical extension cords are unsightly from an aesthetics standpoint and may also create a risk that one of the many patrons of the casino will trip over the extension cord and fall. To avoid the problem of the electrical extension cords, the tables could be placed closer to the electrical outlets. However, placing the tables in this manner would generally result in a less dense placement of the gaming tables within the casino itself. A lesser density or number of gaming tables generally reduces the overall profitability of the game to the casino. Since the profitability is directly related to the number of rounds of the game which may be played, and since the number of rounds is directly related to the number of gaming tables in the casino, fewer tables means lower profitability.

Another example of the disadvantages associated with many previous automatic card shuffling machines is that the shuffling operation itself is not observable by the players and the dealer. Frequently, the card shuffling occurs interiorly within the machine at a location obscured from view. Many serious players are uncomfortable with such arrangements because of a suspicion that the mechanism of the machine itself may be fixed to order the cards in a non-random or unfair order. Additionally, the obscured shuffling action may detract some of the entertainment value of the game that many players appreciate. Further still, any jam in the cards or any malfunction in the machine is difficult or impossible to remedy, because of the closed and inaccessible nature of the mechanism which accomplishes the shuffling operation. Many previous automatic card shuffling machines can not operate at a high rate of speed without creating jams of cards or defects in the shuffling process. For example, malfunctions in the shuffling process may permanently deform or mark the cards, or allow cards to flip over or become inverted relative to other shuffled cards thereby revealing the value of the card. Such defects destroy or reduce the player's confidence that the shuffling process has been properly accomplished.

It is with respect to these and other factors that the present invention has evolved.

SUMMARY OF THE INVENTION

The present invention relates to a new and improved automatic card shuffler which is highly effective in randomly and fairly shuffling a large number of playing cards from multiple decks in a relatively short amount of time.

Furthermore, the automatic card shuffler performs the shuffling function in full view of the dealer and the players, thereby contributing to the confidence in the random, fair nature of the shuffle while simultaneously promoting the entertainment and aesthetics aspect of playing the game. The automatic card shuffler is also effective in avoiding card jams, which again contributes to the player's confidence in the integrity of the shuffle. However, should a problem arise it is easily remedied by the dealer because of the relatively simple, observable and accessible mechanism which shuffles the cards. The size of the automatic card shuffler allows it to occupy a relatively small amount of space on the gaming table, thereby avoiding a non-aesthetic appearance on the table. The size and features of the automatic card shuffler also contribute to its ease of use. The automatic card shuffler employs a less complex card shuffling mechanism to allow the use of a self-contained power supply, thereby making it completely portable and avoiding the use of electrical extension cords for its operation.

These and other aspects of the present invention are obtained by a card shuffling machine for shuffling playing cards into a shuffled card collection. The card shuffling machine comprises two card holding bins, each of which are adapted to receive an unshuffled card stack formed by a plurality of playing cards. Each card holding bin further includes a gateway opening through the cards are removed from the unshuffled card stack and are propelled into a confluence chamber. A card propelling mechanism is positioned adjacent to the gateway opening and is operative to contact a bottom card from the unshuffled card stack. The card propelling mechanism propels at least the bottom card through the gateway opening in a trajectory which intersects the trajectory of the bottom card propelled from the other gateway opening. The gateway opening and the card propelling mechanism limit the number of cards that can be simultaneously propelled at one time to a random number of cards which is greater than one card and equal to or less than a predetermined maximum number of cards, for example three.

Additional preferred features of the shuffling machine involve limiting the number of cards simultaneously propelled at one time through the gateway opening by use of a protrusion in the gateway opening. The protrusion elastically bends the cards which pass through the gateway opening. Preferably the card propelling mechanism includes two wheels disposed a predetermined distance apart and having a substantially uniform relative height. The protrusion is positioned between the two wheels and extends a predetermined distance below the relative height of the two wheels to bend a portion of each card below the relative height of the two wheels when the cards are propelled through the gateway opening by the wheels. A beveled edge of the protrusion is contacted by the cards moving through the gateway opening.

The protrusion bends no more than the predetermined maximum number of cards which are maintained together by random surface and frictional forces between the cards as the bottom card is gripped and propelled by the wheel, and to restrain additional cards greater than the predetermined maximum number.

Other preferred features of the shuffling machine include a card deflector positioned substantially at the intersection point of the two card trajectories to deflect the cards into the interleaved relationship. The card deflector is located closer to one gateway opening than the other gateway opening to facilitate deflection of the cards.

Another preferred feature of the shuffling machine relates to an elevator mechanism upon which the interleaved cards from the trajectories settle in the confluence chamber. The elevator mechanism includes a support upon which the interleaved cards accumulate in the shuffled card collection. The support moves the upper surface of the accumulated cards downwardly at approximately the same rate as the cards from the trajectories accumulate, thereby allowing an insufficient space to allow the cards to turn inverted in the confluence chamber. The card shuffling machine may also include an accumulation opening in which the shuffled card collection accumulates and where the support of the elevator mechanism moves to maintain the upper surface of the accumulated cards at approximately the same location.

The card shuffling machine also preferably includes a pinnacle extending upward to support the lowermost card and the unshuffled stack in each card holding bin. The pinnacle and the outer peripheral surfaces of the two wheels contact the bottom card of the unshuffled card stack at three points in a plane. This three point contact helps assure that the lowermost card or cards are propelled through the gateway openings without being skewed. A second lower pinnacle in addition to the first pinnacle helps support bent cards to assure that they will also be adequately propelled through the gateway openings.

A more complete appreciation of the nature, scope and improvements of the present invention can be obtained by reference to the accompanying drawings, which are briefly described below, the following detailed description of presently preferred embodiments of the invention, and the appended claims.

BRIEF DESCRIPTION OF THE DRAWINGS

FIGS. 7, 8 and 9 are partial sectional views of a complete upper portion of the shuffling machine taken substantially in the plane of line 4—4 shown in FIG. 2, and showing the operation of the shuffling machine in sequentially shuffling cards.

FIG. 10 is a sectional view of the shuffling machine taken substantially in the plane of line 10—10 shown in FIG. 3.

FIG. 11 is a sectional view similar to FIG. 10.

DETAILED DESCRIPTION

Figure 1:
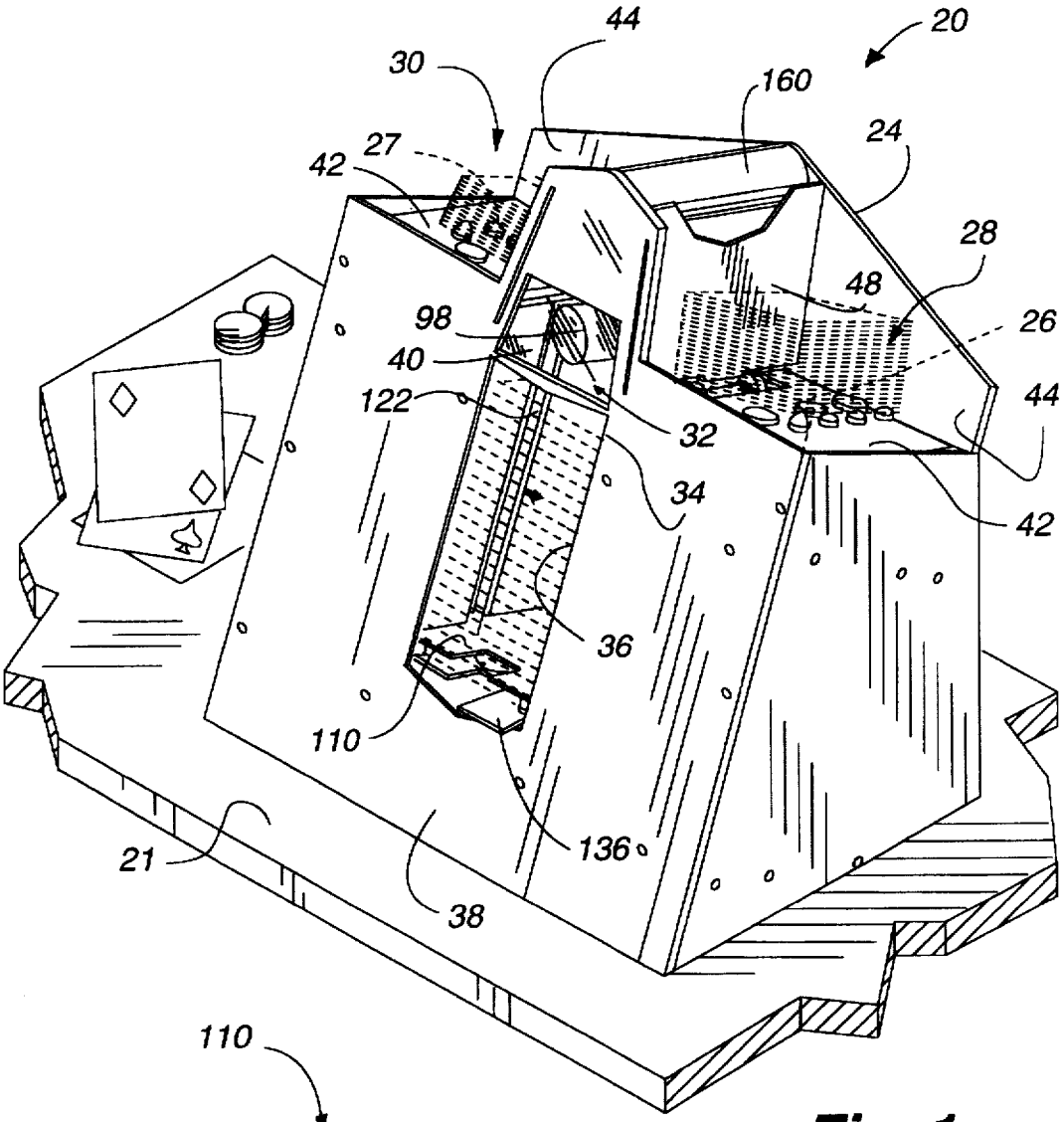
FIG. 1 is a perspective view of an embodiment of a high-capacity, automatic playing card shuffling machine incorporating the present invention.
Figure 12:
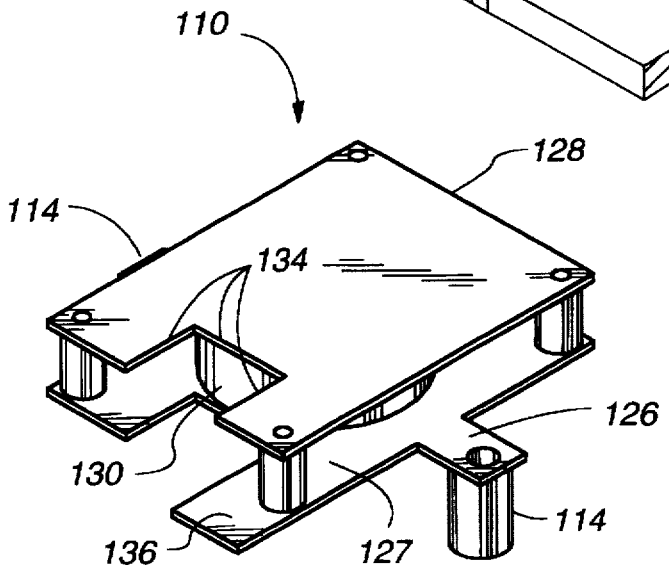
FIG. 12 is an enlarged perspective view of a card platen of an elevator mechanism of the shuffling machine shown in FIG. 1.

An embodiment 20 of an automatic playing card shuffling machine incorporating the present invention is shown in FIG. 1, resting on a playing surface of a gaming table 21. The shuffling machine 20 includes a housing 24 that defines two card holding bins 28 and 30. The playing cards are collected after each round of play, and divided into two unshuffled stacks 26 and 27. The unshuffled stacks 26 and 27 are stacked initially in the card holding bins 28 and 30, respectively. The shuffling machine 20 simultaneously removes playing cards from the bottom of the two unshuffled card stacks 26 and 27 and propels the removed cards into a confluence chamber 32 in intersecting trajectories or paths toward one another. The cards from the two separate paths intersect and combine in an interleaved manner in the confluence chamber and settle into a shuffled card collection 34. The cards of the shuffled collection 34 accumulate on a platen 110 of an elevator mechanism which travels vertically within an accumulation opening 36 of the shuffling machine housing 24. The platen 110 of the elevator mechanism moves downwardly in response to the accumulating number and weight of the cards in the shuffled card collection 34.

The operation of the shuffling machine terminates after the unshuffled stacks 26 and 27 have been combined into the shuffled card collection 34. The dealer removes the shuffled collection 34 from the accumulation opening 36 and uses the shuffled card collection 34 for the next round of play. When the shuffled collection 34 is removed from the platen 110, the platen 110 returns to an upper position to support the next subsequent collection 34 of shuffled cards at the beginning of the next shuffling operation.

Figure 2:
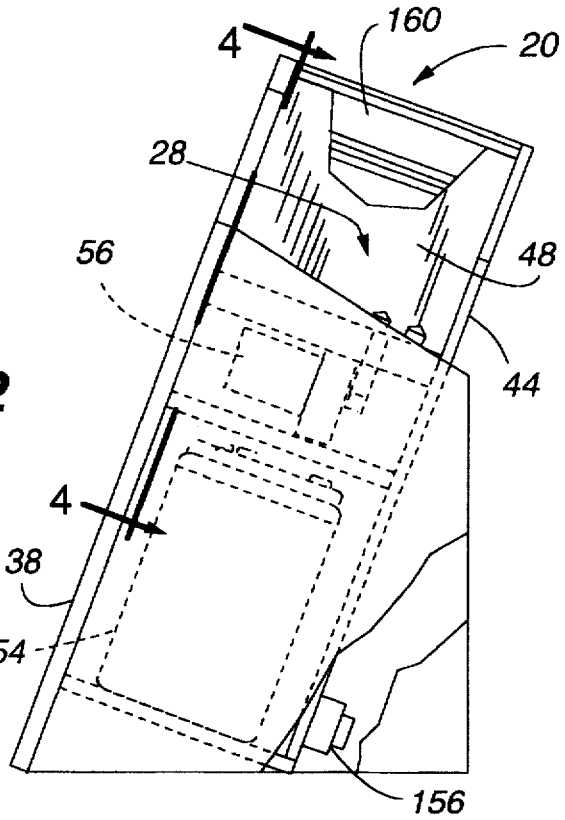
FIG. 2 is a side elevation view of the shuffling machine shown in FIG. 1, with portions broken away.

The card holding bins 28 and 30 are preferably similar in configuration, with each bin 28 and 30 being the substantial mirror image configuration of the other, as shown in FIGS. 1–5. Each card holding bin 28 and 30 is bounded on three sides by a deck plate 42, a back plate 44, and a gate plate 48 or 50. The right-hand card holding bin 28 (as shown in FIG. 2) differs in shape from the left-hand card holding bin 30 (as shown) only in that the height of its gate plate 48 extends above the height of the gate plate 50 of the card holding bin 30. Thus the card holding bin 28 is capable of holding a larger number or higher stack 26 of unshuffled cards than the card holding bin 30.

Preferably, the shuffling machine 20 is situated on the gaming table so that the card holding bin 28 is located adjacent to the dealer, thereby allowing the dealer to discard the played cards directly into the large card holding bin 28. Height markings (not shown) are preferably placed on the gate plate 48 to indicate the approximate number of unshuffled cards and decks that are contained within the card holding bin 28. For example, the larger card holding bin 28 may hold eight decks of cards, and the graduated markings on the gate plate 48 indicate when two, four, six and eight decks of unshuffled cards (both plastic and paper cards) have accumulated within the card holding bin 28. Once all of the played or discarded cards have accumulated within the card holding bin 28, the unshuffled cards are divided approximately evenly into the two equally sized unshuffled card stacks 26 and 27 by use of the graduated markings. If no graduated markings are employed on the card holding bin 28, the discarded or played cards are divided visually into two approximately equally sized unshuffled stacks 26 and 27. With an approximately equal numbers of cards in each unshuffled stack, a maximum amount of interleaving of the cards is obtained when the cards of both stacks 26 and 27 are combined.

A front surface plate 38 of the housing 24 defines the accumulation opening 36. The accumulation opening 36 allows the dealer to grasp the shuffled card stack 34 and lift the stack of cards off the platen 110 and remove the stack from the machine 20. A window 42 is also formed in the front surface plate 38 at the upper end of the card accumulation opening 36 in front of the confluence chamber 32. The window 42 is covered with transparent material to enclose the confluence chamber 32. The enclosure of the confluence chamber on four sides prevent the cards from bouncing out of the machine 20 when they are combined at high speed. The enclosed confluence chamber 32 also causes the combined cards to settle into an ordered collection 34. In addition to the visibility into the confluence chamber 32, the window 42 allows the players and the dealer to observe the flow of cards through the machine 20 during the shuffling operation.

A card propelling mechanism is associated with each card holding bin 28 and 30. The card propelling mechanism removes the cards from the bottom of each unshuffled stack 26 and 27, and propels the removed cards in the trajectories into the confluence chamber 32. Each card propelling mechanism includes a pair of wheels 52 which are fixed to a shaft 54 and which rotate in unison with the shaft 54. An electrical motor 56 rotates the shaft 54 by a belt 58 which extends around the shaft 54 and over a pulley 60 connected to the electrical motor 56, as shown in FIGS. 3–5 and 7–9. The belt 58 transfers power smoothly and quietly to the wheels 52.

Figure 4:
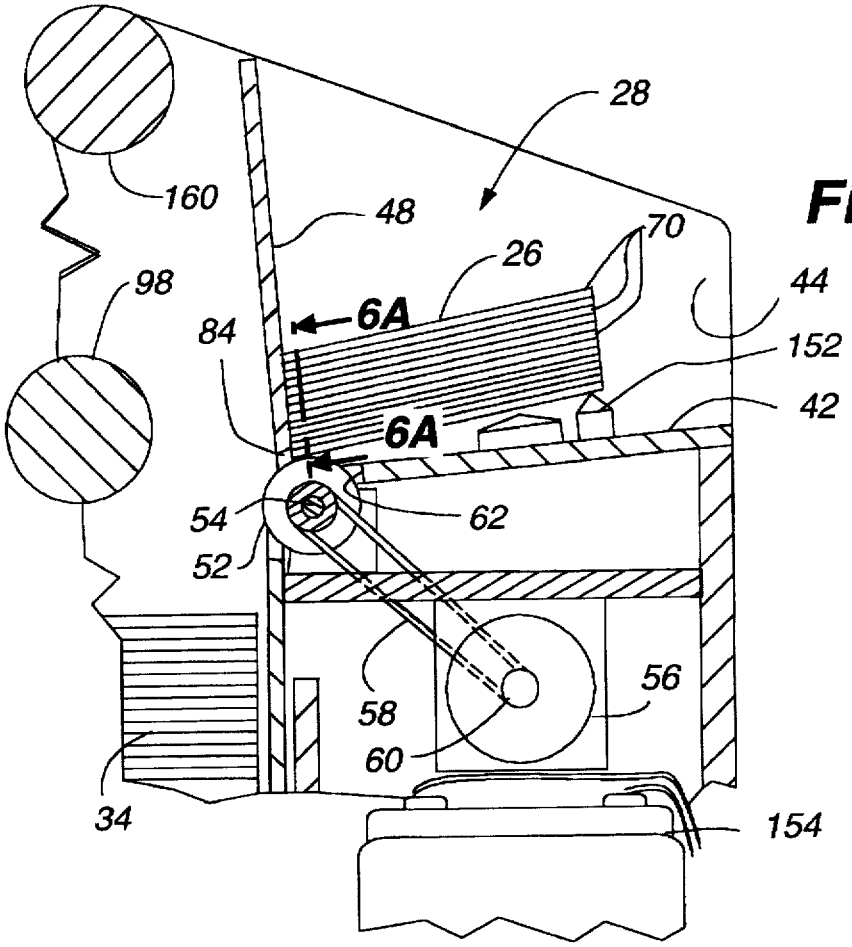
FIG. 4 is an enlarged sectional view of a portion of the shuffling machine, taken substantially in the plane of line 4—4 shown in FIG. 2.
Figure 5:
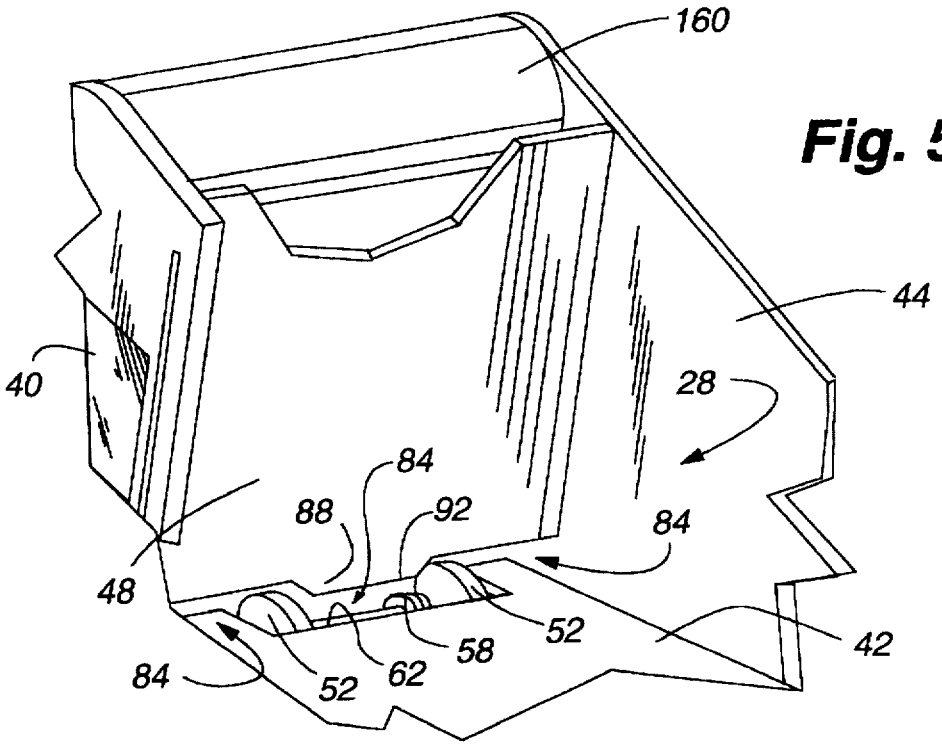
FIG. 5 is an enlarged perspective view of the portion of the shuffling machine shown in FIG. 4.

The shaft 54 and the wheels 52 are supported within the housing 24 substantially at the junction of the deck plates 42 and the gate plates 48 and 50 so that the wheels 52 protrude upwardly through a cut-out region 62 of the deck plates 42, as shown in FIGS. 4 and 5. Positioned in this manner, the wheels 52 are situated to contact the lower inside edge of the lowermost card in the unshuffled card stacks 26 and 27. The wheels 52 are formed of elastomeric, tractionable material, preferably a silicone rubber compound, which will frictionally grip the surface of the playing cards and propel them into the confluence chamber 32.

The front surface plate 38 of the housing 24 and the back plates 44 of the card holding bins 28 and 30 are preferably parallel and inclined at approximately 20 degrees to a vertical reference, as shown in FIGS. 2, 10 and 11. The deck plates 42 of the bins 28 and 30 are also is preferably inclined rearwardly by approximately 20 degrees to a horizontal reference. Furthermore, the deck plates 42 are also inclined transversely to converge downwardly with respect to one another by approximately 5 degrees to a horizontal reference, as shown in FIGS. 3, 4, and 7–9. Both deck plates 42 converge toward the gate plates 48 and 50, and the lower inside edge of each deck plate 42 is adjacent to each gate plate, 48 and 50. With these inclinations, the unshuffled card stacks 26 and 27 in the card holding bins 28 and 30, as well as the shuffled card stack 34 in the accumulation opening 36, are held back against the back surfaces of the card holding bins and the accumulation opening, and are prevented from sliding or falling out of the machine 20.

The cards are propelled from the card holding bins 28 and 30 into the confluence chamber 32 through a gateway opening 84 shown in FIGS. 5 and 6. The gateway opening 84 is defined by an open space at the intersection the gate plates 48 and 50 and deck plates 42 in each card holding bin 28 and 30. The gateway opening 84 provides access for transferring the cards from card holding bins into the card accumulation confluence chamber 32 and opening 36. The unshuffled card stack 26 or 27 is positioned against the gate plate 48 or 50 and the back plate 44 so that the lower inside edge of the bottom card in the unshuffled card stack rests on the pair of wheels 52 protruding into the gateway opening 84. Once the motors 56 are energized, the shaft 54 and the wheels 52 turn and propel the bottom card of the stack 26 or 27 through the gateway opening 84. As the cards are propelled through the gateway opening 84, the remainder of the unshuffled card stack 26 or 27 maintains its position against the gate plate 48 or 50 and the back plate 44 due to the inclination of the deck plate 42. In this manner, the wheels 52 act to propel a constant stream of bottom cards from the unshuffled stacks through the gateway opening 84, into the confluence chamber 32 and onto the shuffled card stack 34.

To ensure a random order during the shuffling operation, it is desirable that a randomly variable number of cards (preferably ranging from one to three) be transferred at a time from each of the unshuffled card stacks 26 and 27 into the confluence chamber. To achieve such randomness, the gateway openings 84 are sized to meter from one to three cards (preferably) at a time from the bottom of each unshuffled card stack 26 or 27. The gateway openings therefore constitute a card metering mechanism, and the functionality of this card metering mechanism is achieved by the configuration of the gateway opening 84.

Figure 6A:
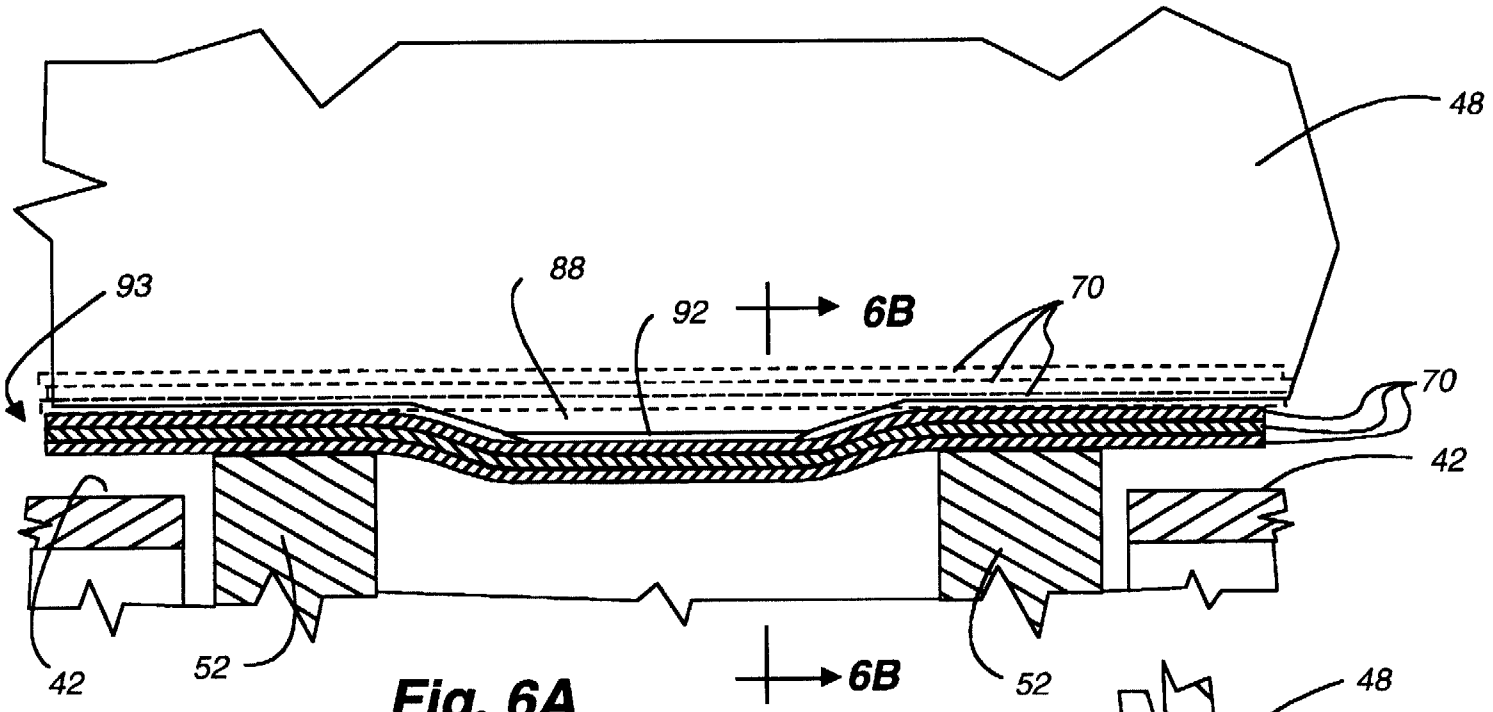
FIG. 6A is an enlarged partial sectional view taken substantially in the plane of the line 6A—6A shown in FIG. 4.
Figure 6B:
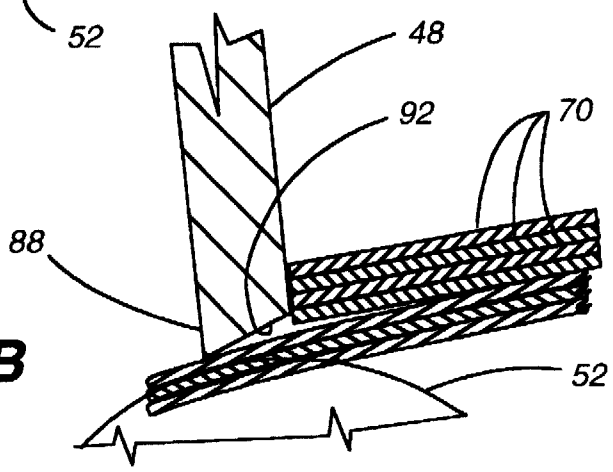
FIG. 6B is a section view taken substantially in the plane of line 6B—6B shown in FIG. 6A.

The card metering mechanism is shown in FIGS. 5, 6A and 6B. The gate plates 48 and 50 each include a protrusion 88 extending into the space between the wheels 52. The protrusion 88 extends to a predetermined vertical position below the top surfaces of the wheels 52, as shown in FIG. 6A. As the wheels 52 contact the bottom card within the unshuffled card stack 26 or 27, an inherent but variable frictional or surface tension force between the surfaces of the playing cards tends to maintain the bottom card in contact with the immediately adjacent upper card, as well as to maintain contact of the one or more next immediately adjacent upper cards within the unshuffled stack. As many of the immediately adjacent cards as the random friction and surface tension will permit to be forced around the protrusion 88 and through the gateway opening 84 will be propelled into the confluence chamber 32.

The number of cards propelled at a time is limited by the position of the lower beveled edge 92 of the protrusion 88, which establishes the amount of force required to bend the cards elastically slightly downwardly between the wheels 52 to pass beneath the protrusion 88, and the surface tension and friction between the cards. The limiting or metering effect is achieved because of a balance between the forces required to bend the cards elastically to pass under the protrusion and the forces which tend to hold the cards together.

As is best understood by reference to FIGS. 4, 5, 6A and 6B, the cards 70 pulled from the unshuffled stacks 26 and 27 by the wheels 52 will encounter the beveled edge of the protrusion 88. The bottom card, and one or more adjacent cards which are carried with the bottom card, will be elastically bent between the edge 92 and between the wheels 52, as shown in FIG. 6A, as the cards move below the protrusion. The frictional force developed by the beveled edge 92 and the protrusion 88 is increased as a result of the downward deflection of the cards 70 between the wheels 52 by the protrusion 88. This frictional force tends to limit the number of cards carried with the bottom card.

Shear forces develop between the bottom adjacent playing cards as the wheels continue to propel the bottom card through the gateway opening 84. The shear forces rise until one of the playing cards shears free of an adjacent card, thereby allowing the freed cards to be propelled through the gateway opening 84. The bottom card is always propelled through the gateway opening, and potentially one or two adjacent cards also pass through the gateway opening 84 depending upon the balance between the frictional and surface tension forces which tend to hold the cards together relative to the frictional forces caused by the elastic deformation of the cards 70 between the wheels 52 and the frictional contact with the beveled edge 92. Once the cards pass through the gateway opening 84, the remaining cards within the card holding bin move downwardly so that a new bottom card contacts the wheels 52, thereby repeating the above described cycle.

Since the frictional and surface tension forces between the card surface is variable due to the condition of the cards and a variety of other factors, the retaining forces between any two adjacent cards is likewise variable. Consequently, a random number of cards (preferably one to three) are removed from the bottom of each unshuffled card stack 26 or 27 and passed through the gateway opening 84 to be combined into the shuffled card collection 34. The predetermined maximum number of cards that can simultaneously pass through the gateway opening 84 is substantially defined by the dimensions of the gateway opening 84 and, in particular, the distances between the protrusion 88 and the wheels 52, as well as the angle of the beveled edge 92 at the bottom of the protrusion 88. In this manner, the actual number of cards which are transferred from the stack with each cycle will vary between one and three cards.

Figure 7:
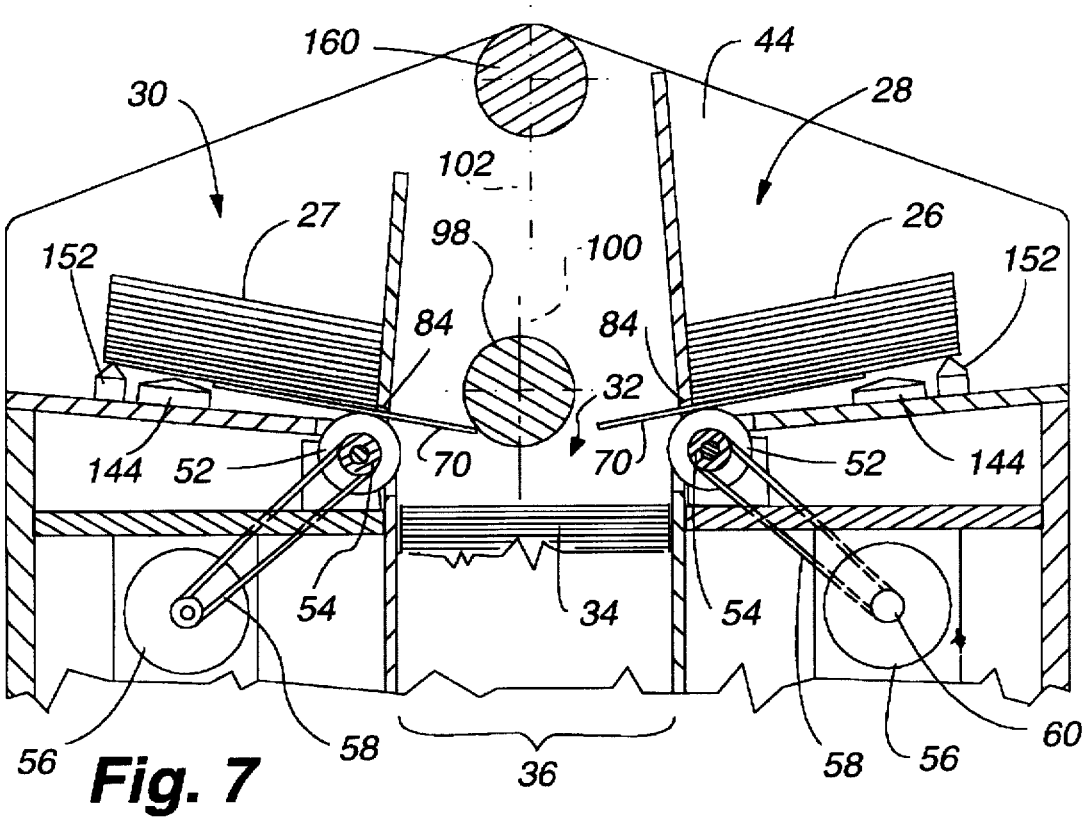
Figure 8:
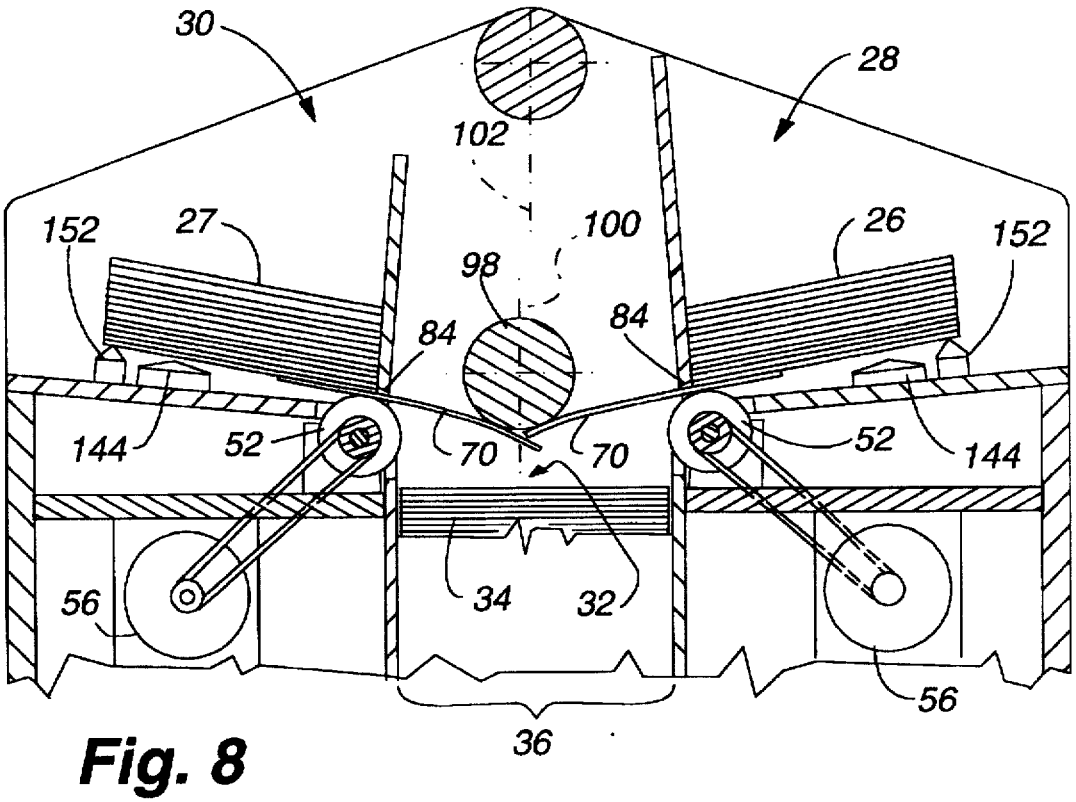

FIGS. 7–9 illustrate the operation of combining the cards 70 removed from the bottom of each unshuffled card stack 26 and 27. For illustrative purposes, individual cards 70 are shown delivered one at a time, although the same operation occurs when more than one card at a time is delivered at a time as described above. Once the cards 70 are propelled through the openings 84 by the wheels 52, they contact a rounded card deflector 98 at the intersection point of the trajectories in the confluence chamber 32, and the cards are directed into an interleaved relationship. To reduce the potential for the cards 70 to become jammed (such as when two or more cards enter the bin 36 simultaneously from the opposing card holding bins 28 and 30), the card deflector 98 is preferably offset laterally within the confluence chamber 32 as shown by the centerline 100 compared to a centerline 102 through the confluence chamber 32 in FIGS. 7–9. The lateral offset of the cylindrical card deflector 98 positions it closer to one of the gateway openings 84 than to the other one of the gateway openings 84.

As shown in FIG. 7, the card 70 removed from the left card holding bin 30 contacts the card deflector 98 within a shorter movement distance than the distance required for the card 70 removed from the right card holding bin 28 to move. Consequently, the card 70 on the left is bent downward first so the card 94 on the right can interleave above it. In this manner, a head-on impact along the leading edges of the converging cards 70 is substantially avoided, and as shown in FIG. 8, the cards combine more smoothly, thereby reducing the possibility of the cards 70 jamming within the confluence chamber 32. Alternatives (not shown) to the card deflector 98 may be utilized. The deflector should present an angled deflection surface to the approaching cards and should include means (such as an offset in height of the card holding bins or deflection surfaces of varying angles) to reduce the possibility of a direct edge-on card impact within the confluence chamber 32.

As the cards 94 are moved from the unshuffled card stacks 26 and 27 and are interleaved with one another, an elevator mechanism (which includes the platen 110) supports the shuffled card collection 34 with its upper card at a substantially uniform location within the confluence chamber 32. This uniform upper surface location contributes to the interleaved cards settling in an ordered manner without tipping over.

The platen 110 moves vertically within the accumulation opening 36, as is shown by FIGS. 1, 3 and 10–12. The platen 110 is supported by and moves along support rods 112 which extend vertically on opposite transverse sides of the accumulation opening 36. The support rods 112 guide the vertical movement of the platen 110. The collars 114 each contain conventional linear bearings 118 (FIGS. 10 and 11), preferably of the type which includes recirculating ball bearings that contact the rods 112 to minimize frictional resistance to the vertical movement. The collars 114 are connected to the platen 110 by arms 126. The arms 126 and the collars 114 extend from opposite transverse sides of the platen 110 into channels 122 located on opposite sides of the accumulation opening 36.

The platen 110 includes a relatively thin and light weight lower plate 127 and a similar upper plate 128 which are held in a separated relationship by spacers and fasteners. The arms 126 extend from the lower plate 127. The upper plate 128 is flat to facilitate supporting the shuffled card collection 34. The lower plate 127 includes a center hole surrounded by a cylindrical sleeve 130. The center hole in the lower plate 127 and the cylindrical sleeve 130 form a cup to receive the upper end of a helical spring 132. The spring 132 urges the platen 110 upward along the rods 118. The lower end of the spring 132 is connected to the housing 24 at a bottom surface of the accumulation opening 36.

Initially, the platen 110 is pushed upwardly by the spring 132 to a predetermined uppermost position within the accumulation opening 36. At this position, an upper surface 128 of the platen 110 is positioned slightly below the level of the gateway openings 84 and is preferably positioned just at the lowest point of the confluence chamber 32 and slightly above the level of the accumulation opening 36, to ensure that playing cards will not be expelled through the opening 36 as they are combined in the confluence chamber. As the size of the shuffled card collection 34 atop the platen 110 grows, the platen moves downward along the rods 112 as the spring 132 compresses under the increasing weight of the shuffled card collection 34. The compression characteristics of the spring 132 are chosen so that the spring compresses at a substantially constant rate under the influence of the accumulating cards to maintain a top surface of the shuffled card collection 34 at the substantially constant position within the confluence chamber 32 as shown in FIGS. 10–11. The platen 110 is preferably of the lightest construction possible to assist in causing its movement to be as closely related as possible to the increasing weight from the accumulated cards. The helical spring 132 and the support rods 112 could be replaced with lead screws, a stepper motor and a control system, or other similar means, to provide the substantially constant location of the upper surface of the card collection 34.

The substantially constant location of the upper surface of the shuffled card collection 34 helps prevent the playing cards from tipping over. By maintaining a minimal distance between the deflector 98 and the top surface of the shuffled card collection 34, the cards are not allowed enough room to be flipped over or become lodged against a side of the bin 36. Furthermore, the likelihood of one or more cards escaping through the opening 36, due to the momentum of the cards as they exit the gateway opening 84, is substantially reduced. Thus, by initially positioning the top plate 128 of the platen 110 as described above, and by maintaining the top surface of the shuffled card collection 34 at a substantially constant position, the shuffling machine 20 provides a uniform shuffled card collection 34 in which all the cards are positioned face down.

Both front edges of the upper and lower plates 128 and 127 include a recessed area 134 that enables the dealer to insert a finger beneath the card collection 34 overlying the recessed area 134. A tab 136 extends from the lower plate 127 out of the accumulation opening 36. The tab 136 allows the dealer to depress the platen 110 and move it and the card collection 34 downwardly within the opening 36. Moving the card collection 34 downwardly exposes the upper surface of the card collection 34, thereby allowing the dealer to insert his or her thumb on the top of the card collection 34 while inserting a finger into the recessed area 134. The shuffled card accumulation 34 is then gripped by finger pressure and lifted off the platen 110 and removed from the accumulation opening 36. Additionally, the height between the upper and lower plates 128 and 127 of the platen provides the dealer with access to the bottom surface of the card collection 34, even when all of the cards are accumulated in the collection 34. Thus, the dealer may always push the tab 136 of the platen 110 to manually lower the platen 110. The dealer may also move the platen in up and down movements if desired to shake the cards into a precisely aligned collection, or to otherwise control the accumulation of the cards, if desired.

The surfaces of the shuffling machine 20 which contact the playing cards are preferably coated with a low-friction material such as Teflon® to reduce the possibility of the playing cards binding as they pass through the machine 20. These potential contact surfaces include at least the deck plates 42, the back plate 44, the gate plates 48 and 50 (including the protrusion 88 and the beveled edge 92), the sides of the bin 36 and the top plate 128 of the platen 110.

Figure 13:
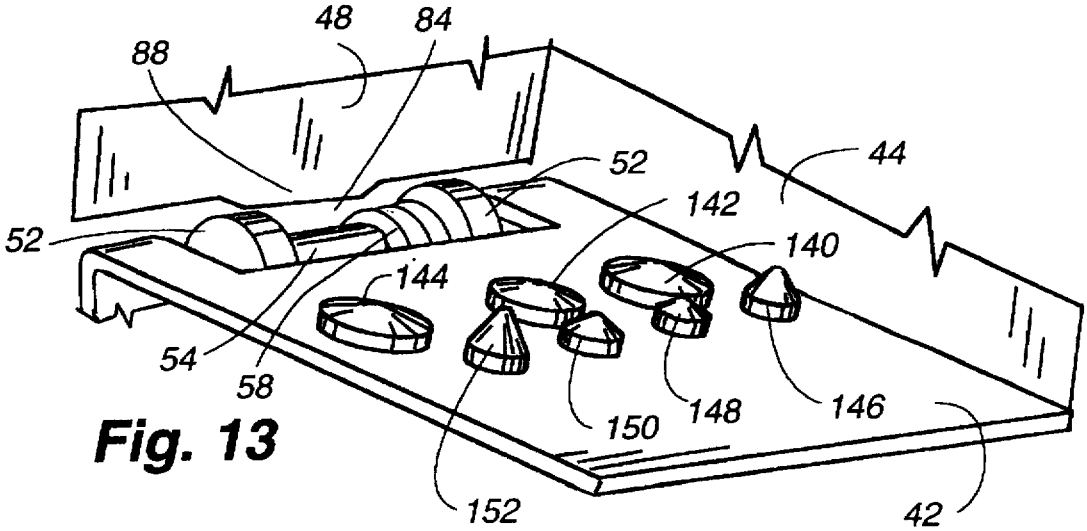
FIG. 13 is an enlarged partial and more inclusive perspective view of a portion of the shuffling machine shown in FIG. 5.
Figure 14:
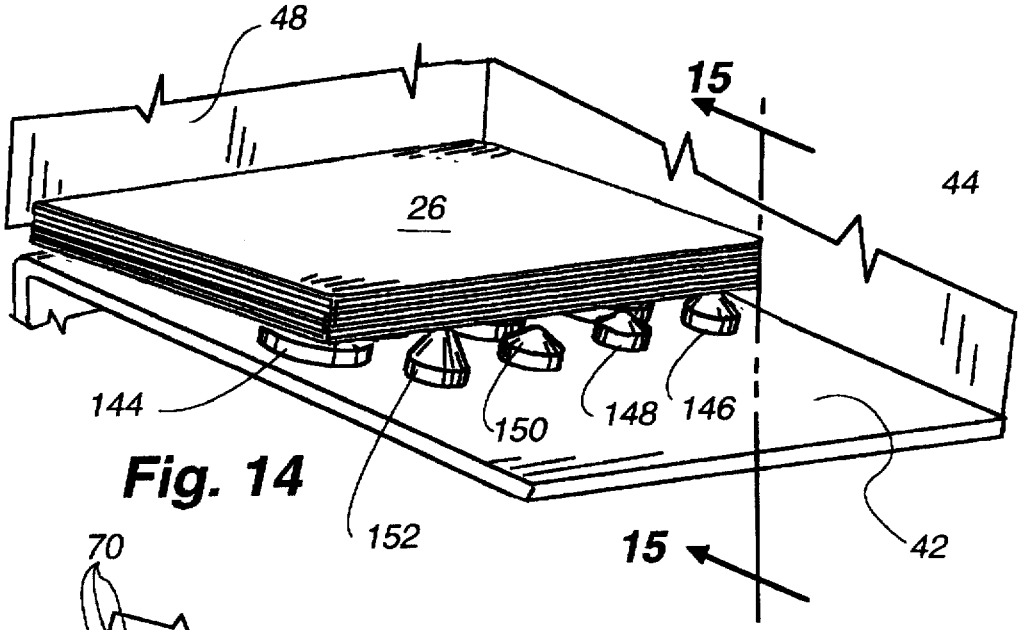
FIG. 14 is a view similar to FIG. 13 additionally showing playing cards.

A plurality of raised pinnacles are preferably fixed to the deck plates 42 of the card holding bins 28 and 30. The pinnacles are illustrated in FIG. 13 without the presence of the unshuffled card stacks 26 or 27. In the preferred embodiment, two rows of pinnacles are fixed on the deck plates 42 with the pinnacles 140, 142 and 144 in a first inner row preferably being of larger diameter or size than the pinnacles 146, 148, 150 and 152 in a second or outer row. However, the pinnacles in the second row preferably have a greater height than those in the first row, with the pinnacle 152 having the overall greatest height.

Figure 15:
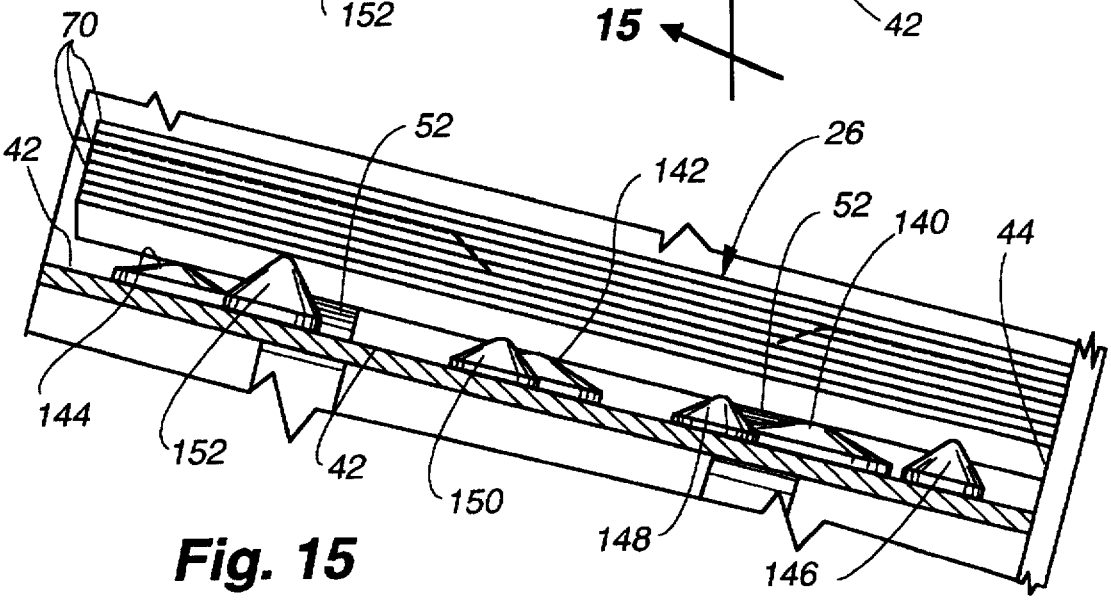
FIG. 15 is a section view of FIG. 14, is taken substantially in the plane of line 15—15.

The unshuffled card stacks 26 and 27 are placed on the pinnacles so that a rear corner of each card stack 26 and 27 is supported on the highest pinnacle 152 while the edge of the card stacks adjacent the gate plates 48 and 50 are supported on the wheels 52. In this manner, the bottom card within the stack 64 is supported in a plane at only three points (i.e., the pinnacle 152 and each of the two wheels 52) as the card stack sits within the card holding bins 28 and 30 (FIG. 15). By raising the rear edge of the card stack 26 or 27 above the deck plate 42, the three-point contact created by the pinnacle 152 maintains positive contact between both wheels 52 and the front inside edge of the card stack at all times. Additionally, by positioning the highest pinnacle 152 at a position on the card stack 26 or 27 diagonally opposite the wheel 52 nearest the back plate 44, the rear wheel encounters more of the weight of the card stack 26 or 27 than the front wheel 52. In this manner, the frictional force applied to the bottom card by the wheel 52 nearest the back plate 44 is greater than the force applied by the front wheel 52. This increased force is beneficial to overcome the frictional drag on the cards caused by movement along the back plate 44. Consequently, the cards move more evenly through the gateway opening 84 to avoid potentially becoming jammed because they might be slightly skewed as they pass through the gateway opening 84.

At high capacity operational speeds, the bottom card of the stack 26 or 27 (and perhaps one or two adjacent cards as described above) is drawn off the supporting pinnacle 152 with such speed that there is insufficient time for the card to contact the deck plate 42 before it is drawn through the gateway opening 84, thereby minimizing the drag force experienced by the card and reducing the possibility that the card will jam as it passes through the gateway opening 84. Furthermore, the pinnacle 152 positions the stacked cards at a downward angle as those cards pass through the gateway opening 84. This downward angle enhances the pinching action as the cards pass underneath the beveled edge 92 of the protrusion 88. However, the height of the pinnacle 152 must be optimized to prevent the angle from becoming so great that the card misses contacting the deflector 98 within the bin 36.

The pinnacle 146 positioned at the opposite end of the second row from the highest pinnacle 152 is preferably second in height of the pinnacles. Thus, while it is preferred that the pinnacle 146 does not contact the bottom card of the stack 64 during normal operation, because it is below the plane defined by the pinnacle 152 and the upper surface of the wheels 52, it is desirable to prevent warped or bent cards from contacting the deck plate 26, thereby eliminating the benefits of the three-point contact noted above. Thus, the pinnacle 146 is provided at the opposite end of the row from the pinnacle 152 to support a corner of the stack 26 or 27 should that corner extend a predetermined distance below the plane of the highest pinnacle 152 and the upper surfaces of the wheels 52. For example, the height of the pinnacle 146 is preferably 0.050 inches lower than the height of the pinnacle 152. By supporting bent cards in this manner, the pinnacle 146 reduces the possibility that the edge of the stack 26 or 27 adjacent the gate plates 48 and 50 will avoid contact with the wheels 80.

Additionally, by supporting the card stack 64 above the deck plate 26, the possibility exists that observers at the gaming table may peer underneath the card stack and visualize each bottom card during the shuffling process. To reduce this possibility, the remainder of the pinnacles on each deck plate 26 are strategically positioned to obscure the view of the bottom card.

The pinnacles may be eliminated and the cards of the unshuffled stacks may rest directly on the deck plates 42, if the friction from the deck plates will not adversely influence movement of the cards.

The preferred size of the gateway opening 84 beneath the protrusion 88 and the preferred speed of the wheels 52 are adjusted to provide an optimal balance between the desire to shuffle the cards as quickly as possible and the desire to avoid card jams and to provide a random ordered quality to the shuffling action. Potentiometers (not shown) may be provided within the housing assembly 24 to adjust the speed of the motors 56.

Figure 3:
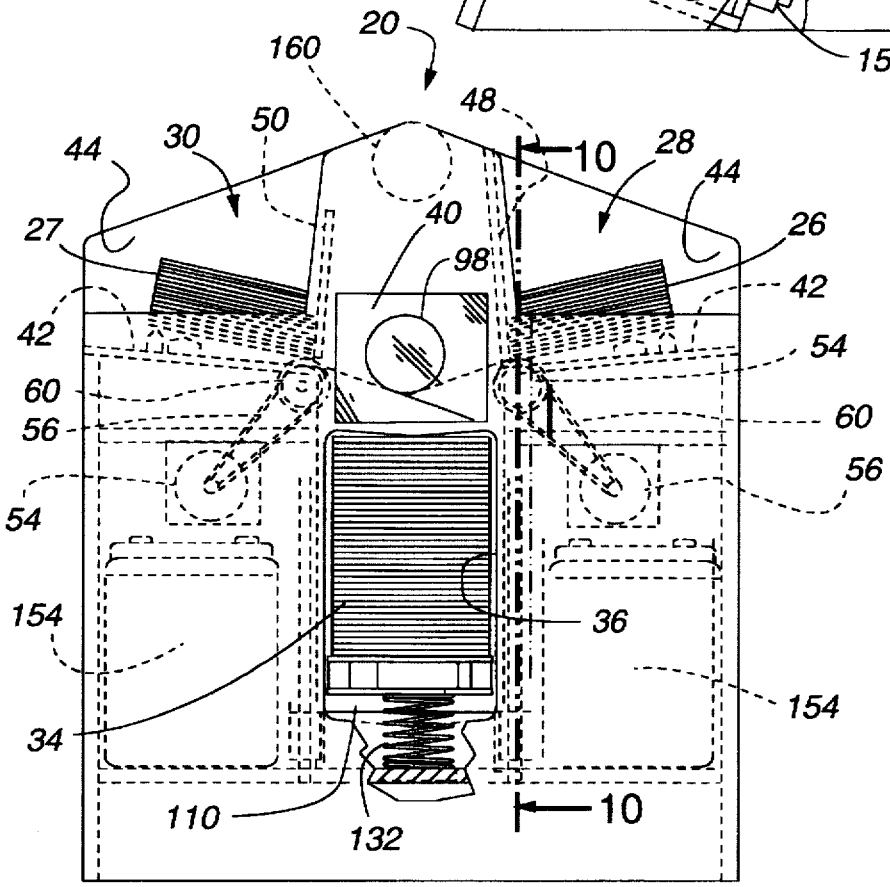
FIG. 3 is a front elevation view of the shuffling machine shown in FIG. 1, illustrated in a plane parallel to the line 4—4 shown in FIG. 2.

Once the unshuffled card stacks 26 and 27 are loaded within the card holding bins 28 and 30, a dealer or operator initiates the shuffling operation by actuating a switch 156 (FIG. 2) on the housing 24. The switch 156 is connected in two circuits that are formed by a pair of batteries 154 and the motors 56 within the housing 24 (FIG. 3). The switch 156 selectively controls the delivery of power from the batteries 154 to the motors 56. Operating the motors independently of one another may induce further randomness in the shuffle if the speeds are slightly different. Operating the motors 56 on battery power enables the shuffling machine 20 to function without requiring access to an external AC power source, thereby enhancing its portability and eliminating the need for connecting cumbersome and unsightly power cords to the gaming tables. Additionally, the batteries 154 are preferably rechargeable DC batteries such as conventional lead-acid batteries. A recharging input (not shown) on the housing 24 allows the batteries 154 to be periodically recharged without having to remove the batteries from the machine 20.

Once the shuffling operation is initiated by actuating the switch 156, the motors 56 continue running for a predetermined time before stopping automatically. The duration of the predetermined time is sufficient for the shuffling machine 20 to shuffle a predetermined maximum number of cards from the card holding bins 28 and 30. A conventional run timer, such as a one-shot timer (not shown), controls the operating time.

A handle 160 is part of the housing 24 and facilitates lifting, carrying and manipulating the shuffling machine 20.

As can be appreciated from the foregoing description, the shuffling machine 20 effectively shuffles the order of playing cards in two unshuffled card stacks to form a shuffled card collection. The card shuffling machine substantially eliminates the possibility of cards becoming jammed, damaged or flipped over. The card shuffler also achieves randomness in reordering the cards while enabling the dealer and players to observe the flow of cards during the shuffling operation. The card shuffler achieves these and other improvements while remaining less complex, more portable and simpler to use than known card shufflers.

The presently preferred embodiment of the invention and its improvements have been described with a degree of particularity. This description has been made by way of preferred example. It should be understood that the scope of the present invention is defined by the following claims, and should not necessarily be limited by the detailed description of the preferred embodiment set forth above.

The invention claimed is:

1. A card shuffling machine for shuffling playing cards into a shuffled card collection, comprising:

two card holding bins each adapted to receive an unshuffled card stack formed by a plurality of playing cards, each card holding bin further including a gateway opening through which cards are removed from the unshuffled card stack;

a confluence chamber located between the two card holding bins, the gateway openings of the two card holding bins facing one another on opposite sides of the confluence chamber;

a card propelling mechanism positioned adjacent to the gateway opening of each card holding bin and operative to contact a bottom card from the unshuffled card stack and propel at least the bottom card through the gateway opening into the confluence chamber in a trajectory which intersects the trajectory of the bottom card propelled from the other gateway opening of the other card holding bin; and wherein:

the gateway opening and the card propelling mechanism limit the number of cards that can be simultaneously propelled at one time from the card holding bin to a random number of cards which is greater than one card and equal to or less than a predetermined maximum number of cards.

2. A card shuffling machine as defined in claim 1 wherein:

the limit on the number of cards simultaneously propelled at one time through the gateway opening is achieved by a protrusion in the gateway opening which elastically bends the cards which pass through the gateway opening.

3. A card shuffling machine as defined in claim 2 wherein:

the card propelling mechanism includes at least one wheel positioned within the gateway opening and having an outer peripheral surface adapted to frictionally grip the bottom card in the unshuffled card stack in the card holding bin and move the bottom card through the gateway opening; and the protrusion in the gateway opening is positioned laterally adjacent to the one wheel.

4. A card shuffling machine as defined in claim 3 wherein:

the card propelling mechanism comprises two wheels disposed a predetermined distance apart and having a substantially uniform relative height; and the protrusion is positioned between the two wheels and extends a predetermined distance below the relative height of the two wheels to bend a portion of each card below the relative height of the two wheels when the cards are propelled through the gateway opening by the wheels.

5. A card shuffling machine as defined in claim 4 wherein:

the protrusion includes a beveled edge which is contacted by the cards moving through the gateway opening.

6. A card shuffling machine as defined in claim 4 wherein:

the two wheels of the card propelling mechanism each grip and propel cards through the gateway opening.

7. A card shuffling machine as defined in claim 4 wherein:

the card propelling mechanism further comprises an electric motor connected to rotate the one wheel.

8. A card shuffling machine as defined in claim 7 wherein:

one electric motor is present in each card propelling mechanism; and further comprising:

an electrical battery connected to each electrical motor.

9. A card shuffling machine as defined in claim 8 further comprising:

a rechargeable battery electrically connected to each motor to separately energize that motor.

10. A card shuffling machine as defined in claim 9 further comprising:

a timer to supply electrical power to the motors for a predetermined time duration sufficient to shuffle the unshuffled card stacks into the shuffled card collection.

11. A card shuffling machine as defined in claim 2 wherein:

the protrusion extends into the gateway opening a predetermined distance to elastically bend no more than the predetermined maximum number of cards which are maintained together by random surface and frictional forces between the cards as the bottom card is gripped and propelled by the wheel, and to restrain additional cards greater than the predetermined maximum number.

12. A card shuffling machine as defined in claim 1 wherein:

the trajectories of the cards in the confluence chamber are angled to intersect one another at an intersection point and interleave the cards into the shuffled card collection.

13. A card shuffling machine as defined in claim 12 further comprising:

a card deflector positioned substantially at the intersection point of the two card trajectories, the deflector contacting the cards in the trajectories to deflect downwardly the leading edges of the cards to facilitate interleaving of the cards into the card collection.

14. A card shuffling machine as defined in claim 13 wherein:

the card deflector includes an angled surface interposed in both trajectories of cards.

15. A card shuffling machine as defined in claim 14 wherein:

the card deflector includes a curved surface imposed in both trajectories of cards.

16. A card shuffling machine as defined in claim 13 wherein:

the card deflector is located closer to the gateway opening in one trajectory from that gateway opening than the card deflector is located in the other trajectory from the other gateway opening.

17. A card shuffling machine as defined in claim 13 further comprising:

an elevator mechanism upon which the interleaved cards from the trajectories settle in the confluence chamber; and wherein:

the card deflector is positioned a predetermined distance above a top surface of the shuffled card collection formed by the cards interleaved from the trajectories, and the the predetermined distance between the top surface of the card collection and the card deflector is insufficient to allow the cards to invert in the card collection after contact with the card deflector.

18. A card shuffling machine as defined in claim 17 wherein:

the elevator mechanism includes a support upon which to accumulate the cards interleaved into the card collection in the confluence chamber; and the support of the elevator mechanism moves the upper surface of the accumulated cards downwardly at approximately the same rate as the cards from the trajectories accumulate in the card collection.

19. A card shuffling machine as defined in claim 12 wherein:

the intersection point is located closer to one gateway opening than it is to the other gateway opening.

20. A card shuffling machine as defined in claim 12 further comprising:

an elevator mechanism having a support surface upon which to support the shuffled card collection accumulated in the confluence chamber; and wherein:

the elevator mechanism moves the support surface downwardly to position an upper surface of the accumulated cards of the shuffled card collection at approximately the same predetermined distance from the intersection point, and the predetermined distance from the intersection point is insufficient to allow the cards to invert before settling into the shuffled card collection.

21. A card shuffling machine as defined in claim 20 further comprising:

an accumulation opening in which the shuffled card collection accumulates; and wherein the elevator mechanism further comprises:

a platen notably positioned within the accumulation opening; and means for moving the platen vertically within the accumulation opening to maintain the upper surface of the accumulated cards of the shuffled card collection at approximately the same predetermined distance from the intersection point.

22. A card shuffling machine as defined in claim 21 wherein:

the means for moving the platen vertically comprises a spring member extending between the card platen and a location of the accumulation opening, the spring member having deflection characteristics to maintain the predetermined distance in response to the accumulating weight of cards in the shuffled card collection.

23. A card shuffling machine as defined in claim 22 wherein:

the platen includes a recess to allow an edge of the shuffled card collection to be gripped and removed from the accumulation opening.

24. A card shuffling machine as defined in claim 21 wherein:

the accumulation opening includes a rear wall which is angled rearwardly with respect to a vertical reference to position the rear wall against the shuffled card collection and to hold the cards in the collection.

25. A card shuffling machine as defined in claim 1 wherein:

the two card holding bins each include a rear wall which is angled rearwardly with respect to a vertical reference to position the rear wall against the unshuffled card stack and to hold the cards in the unshuffled card stack within the card holding bins.

26. A card shuffling machine as defined in claim 1 wherein:

the two card holding bins each include an inside wall extending from the gateway opening, and the inside wall is angled transversly with respect to a vertical reference to position the inside wall the unshuffled card stack and to hold the cards in a bottom region of the unshuffled stack adjacent to the gateway opening.

27. A card shuffling machine as defined in claim 1 wherein:

the two card holding bins each include an bottom wall extending from the gateway opening, and the bottom wall is angled with respect to a horizontal reference to position a lowest point of the bottom wall adjacent to the gateway opening to hold the cards in a bottom region of the unshuffled stack adjacent to the gateway opening.

28. A card shuffling machine as defined in claim 1 wherein:

the two card holding bins each include at least one pinnacle upon which to support the cards in a bottom region of the unshuffled stack at a predetermined inclination to converge the cards of the unshuffled stack toward the gateway opening.

29. A card shuffling machine as defined in claim 28 wherein:

the card propelling mechanism includes at two wheels positioned within the gateway opening and having an outer peripheral surface adapted to frictionally grip the bottom card in the unshuffled card stack in the card holding bin and move the bottom card through the gateway opening, and the two wheels are positioned a predetermined distance apart and have a substantially uniform relative height; and the one pinnacle and the outer peripheral surfaces of the two wheels contact the bottom card of the unshuffled card stack at three points in a plane.

30. A card shuffling machine as defined in claim 29, further comprising:

a second pinnacle in addition to the pinnacle first aforesaid, the second pinnacle extending upward and terminating at a position below the plane defined by the outer peripheral surfaces of the wheels and the first pinnacle.

31. A card shuffling machine as defined in claim 30 wherein:

the second pinnacle is located at a predetermined distance below the plane defined by the outer peripheral surfaces of the wheels and the first pinnacle to prevent permanently bent cards from pivoting out of contact with one of the two wheels.

32. A card shuffling machine as defined in claim 1 wherein:

the confluence chamber is substantially enclosed in four horizontally displaced sides.

* * * * *